US010278451B2

(12) United States Patent
Madore

(10) Patent No.: US 10,278,451 B2
(45) Date of Patent: May 7, 2019

(54) SOLE STRUCTURE WITH LATERALLY ALIGNED FINS

(71) Applicant: NIKE, Inc., Beaverton, OR (US)

(72) Inventor: Carl L Madore, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 233 days.

(21) Appl. No.: 15/165,612

(22) Filed: May 26, 2016

(65) Prior Publication Data

US 2017/0340060 A1 Nov. 30, 2017

(51) Int. Cl.

| | |
|---|---|
| ***A43C 13/04*** | (2006.01) |
| ***A43B 13/22*** | (2006.01) |
| ***A43B 5/00*** | (2006.01) |
| ***A43B 13/04*** | (2006.01) |
| ***A43B 13/14*** | (2006.01) |

(52) U.S. Cl.

CPC ..... *A43B 13/223* (2013.01); *A43B 5/001* (2013.01); *A43B 13/04* (2013.01); *A43B 13/141* (2013.01); *A43C 13/04* (2013.01)

(58) Field of Classification Search

CPC ..... A43B 13/223; A43B 13/04; A43B 13/141; A43B 5/001; A43C 13/00; A43C 13/04; A43C 15/16; A43C 15/162

See application file for complete search history.

(56) References Cited

U.S. PATENT DOCUMENTS

| | | | | |
|---|---|---|---|---|
| 3,581,414 | A * | 6/1971 | Crawford | A43C 13/04 36/59 R |
| 4,538,366 | A * | 9/1985 | Norton | A43B 13/223 36/32 R |
| 4,559,724 | A * | 12/1985 | Norton | A43B 5/06 36/114 |
| 4,667,425 | A * | 5/1987 | Effler | A43B 13/223 36/114 |
| 5,351,421 | A | 10/1994 | Miers | |
| 5,709,954 | A * | 1/1998 | Lyden | A43B 5/00 12/142 R |
| 6,817,117 | B1 | 11/2004 | Campbell | |
| 7,204,044 | B2 | 4/2007 | Hoffer et al. | |
| D578,280 | S * | 10/2008 | Wilken | A43B 13/223 D2/951 |
| 7,650,707 | B2 * | 1/2010 | Campbell | A43B 3/0057 36/102 |

(Continued)

FOREIGN PATENT DOCUMENTS

| | | | |
|---|---|---|---|
| GB | 838866 | A | 6/1960 |
| WO | 9214373 | A1 | 9/1992 |

*Primary Examiner* — Marie D Bays
(74) *Attorney, Agent, or Firm* — Quinn IP Law

(57) ABSTRACT

A sole structure can be used with an article of footwear and includes fins for minimizing spin of at least one foot during the backswing and downswing stages of a golf swing. The sole structure includes an outsole having a forefoot region, a heel region, and a midfoot region between the heel region and the forefoot region, a lateral edge, and a medial edge. The outsole includes an outsole body. At least one plate is disposed on the outsole body. The plate is made of a material that is harder than the material forming the outsole body. Further, the plate includes a plate body disposed on the outsole body and a plurality of fins extending from the plate body. The fins include a fin body and a gusset protruding perpendicularly from the fin body.

19 Claims, 2 Drawing Sheets

(56) References Cited

U.S. PATENT DOCUMENTS

| | | | | |
|---|---|---|---|---|
| 8,418,382 | B2 | 4/2013 | Madore et al. | |
| 8,671,589 | B2 | 3/2014 | Bond et al. | |
| D781,545 | S * | 3/2017 | Greenspan | D2/962 |
| 2008/0282579 | A1* | 11/2008 | Bobbett | A43B 5/001 36/127 |
| 2012/0233886 | A1* | 9/2012 | Madore | A43B 13/141 36/103 |
| 2014/0215853 | A1* | 8/2014 | Rushbrook | A43B 5/001 36/102 |
| 2015/0096195 | A1* | 4/2015 | Bacon | A43B 1/0072 36/87 |

* cited by examiner

SOLE STRUCTURE WITH LATERALLY ALIGNED FINS

TECHNICAL FIELD

The present disclosure relates to a sole structure for an article of footwear. In particular, the present disclosure relates to a sole structure with laterally aligned traction elements.

BACKGROUND

Footwear typically includes a sole configured to be located under a wearer's foot to space the foot away from the ground or floor surface. Soles can be designed to provide a desired level of cushioning. The ground contact surface of the article of footwear can be configured for durability.

SUMMARY

During a golf swing, it is desirable to minimize spin of at least one foot during the backswing and downswing in order to maximize accuracy and distance when hitting a golf ball. To this end, the presently disclosed sole structure can be used with an article of footwear, such as a golf shoe, and includes traction elements, such as fins, for minimizing rotation of at least one foot during the backswing and downswing stages of a golf swing. In certain embodiments, the sole structure includes an outsole having a forefoot region, a heel region, and a midfoot region between the heel region and the forefoot region, a lateral edge, and a medial edge. The outsole includes an outsole body. At least one plate is disposed on the outsole body. The plate is made of a material that is harder than the material forming the outsole body. Further, the plate includes a plate body disposed on the outsole body and a plurality of fins extending from the plate body. At least some of the fins are parallel to each other. The fins include a fin body extending along a lateral direction, wherein the lateral direction extends between the lateral edge and the medial edge. The fin further includes a gusset protruding from the fin body. The gusset extends perpendicularly relative to the fin body in a longitudinal direction, which extends between the heel region and the forefoot region.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items.

Those having ordinary skill in the art will recognize that terms such as "above," "below," "upward," "downward," "top," "bottom," etc., are used descriptively for the figures, and do not represent limitations on the scope of the present teachings, as defined by the claims.

The above features and advantages and other features and advantages of the present teachings are readily apparent from the following detailed description of the best modes for carrying out the teachings when taken in connection with the accompanying drawings.

DETAILED DESCRIPTION

Figure 1:
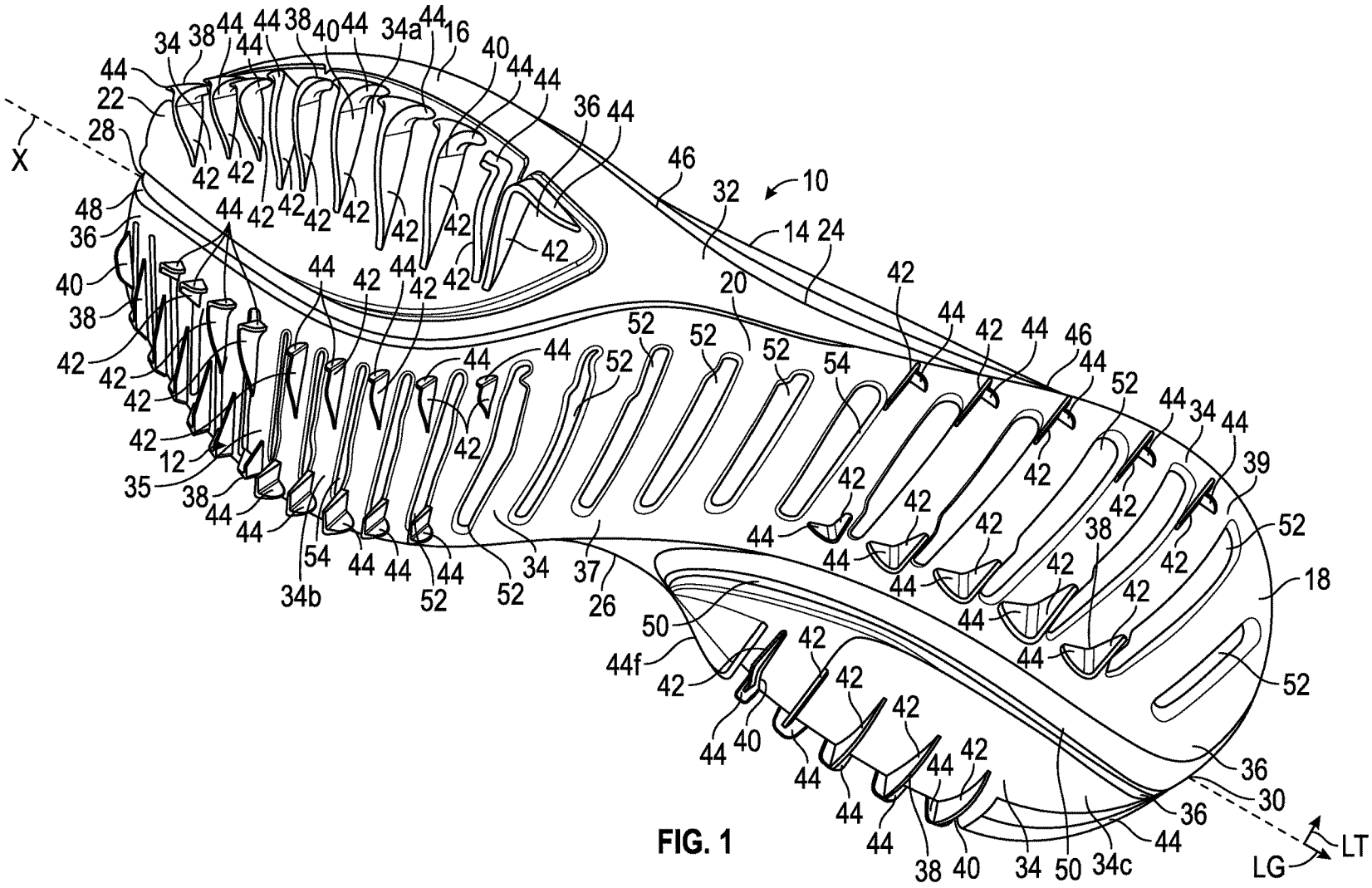
FIG. 1 is a schematic, perspective top view of a sole structure including fins arranged parallel relative to each other.
Figure 2:
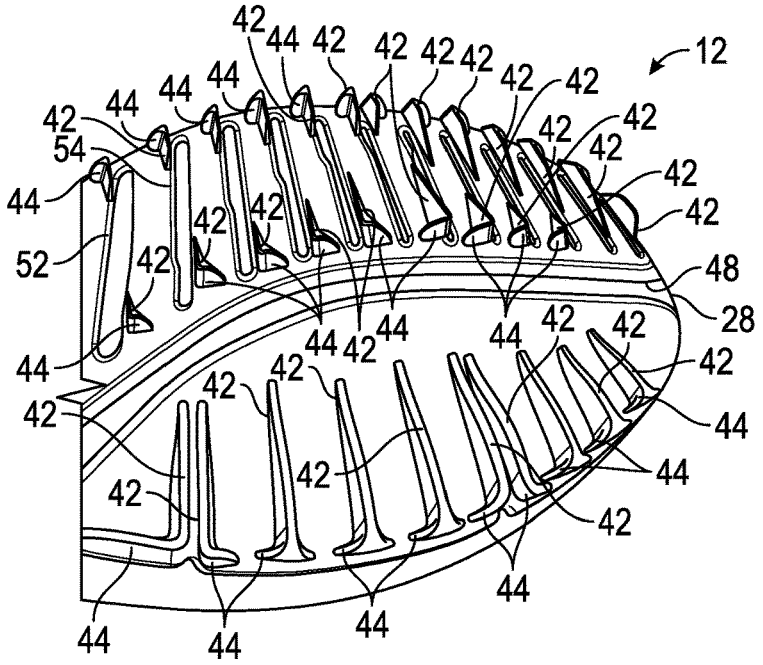
FIG. 2 is a schematic, enlarged perspective top view of the forefoot region of the sole structure shown in FIG. 1.
Figure 3:
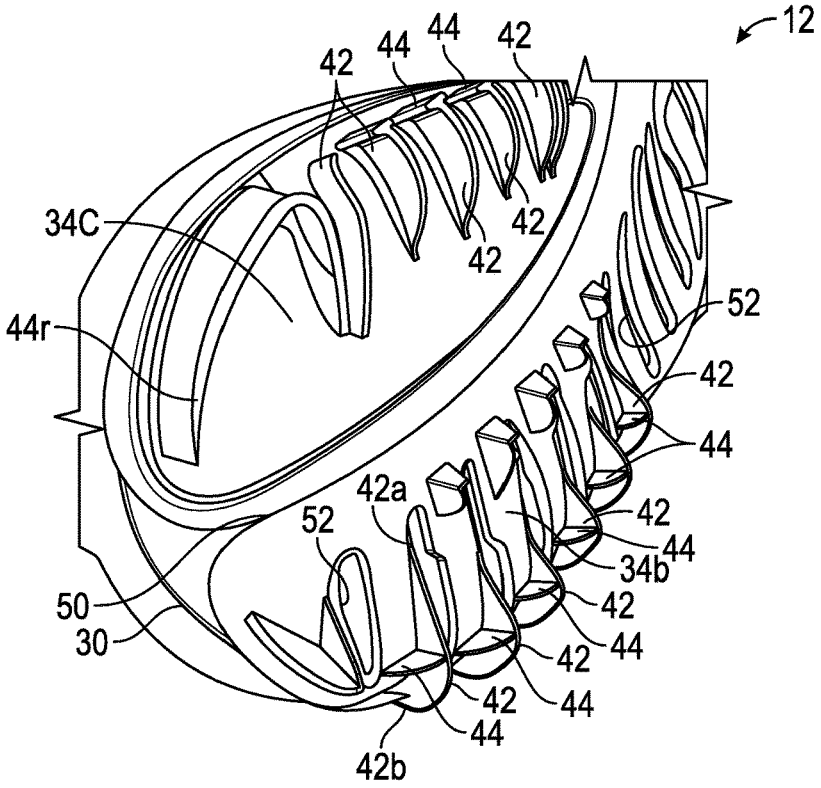
FIG. 3 is a schematic, enlarged perspective top view of the heel region of the sole structure shown in FIG. 1.

Referring to the drawings, wherein like reference numbers correspond to like or similar components throughout the several figures, FIGS. 1, 2, and 3 schematically illustrate a sole structure 12 for an article of footwear 10. The article of footwear 10 further includes a footwear upper 14 (FIG. 1) secured to the sole structure 12. As a non-limiting example, the article of footwear 10 may be a golf shoe. The sole structure 12 includes an outsole 16 configured to contact the ground.

For purposes of reference, the outsole 16 extends along a central longitudinal axis X and has a heel region 18, a midfoot region 20, and a forefoot region 22. The midfoot region 20 is between the heel region 18 and the forefoot region 22. For purposes of discussion, the heel region 18, the midfoot region 20, and the forefoot region 22 are defined as the rearmost third, the middle third, and the foremost third of the outsole 16, respectively. The heel region 18 generally includes portions of the outsole 16 corresponding with rear portions of a human foot including the calcaneus bone and of a size corresponding with the outsole 16 and article of footwear 10. The forefoot region 22 generally includes portions of the outsole 16 corresponding with the toes and the joints connecting the metatarsals with the phalanges of the human foot of the size corresponding with the outsole 16 and article of footwear 10. The midfoot region 20 generally includes portions of the outsole 16 corresponding with an arch area of the human foot of the size corresponding with the outsole and article of footwear 10. Accordingly, the midfoot region 20 is also referred to as the outsole arch region.

As used herein, a lateral side of a component for the article of footwear 10, such as an lateral edge 24 of the outsole 16, is a side that corresponds with the side of the foot of the wearer of the article of footwear 10 that is generally further from the other foot of the wearer (i.e., the side closer to the fifth toe of the wearer). The fifth toe is commonly referred to as the little toe. A medial side of a component for the article of footwear 10, such as a medial edge 26 of the outsole 16, is the side that corresponds with an inside area of the foot of the wearer and is generally closer to the other foot of the wearer (i.e., the side closer to the hallux of the foot of the wearer). The hallux is commonly referred to as the big toe. The lateral edge 24 and the medial edge 26 both extend around the periphery of the outsole 16 from the foremost edge 28 to the rearmost edge 30 of the outsole 16.

The outsole 16 includes an outsole body 32. The outsole body 32 can be a single-piece or unitary structure and can be manufactured using an insert molding process. The material for the outsole body 32 may be selected to provide a desirable combination of durability and flexibility. For example, the outsole body 32 may be wholly or partly made of a thermoplastic, such as a thermoplastic rubber, ethylene vinyl acetate (EVA) or other suitably durable material. As a non-limiting example, the outsole body 32 is wholly or partly made of thermoplastic polyurethane (TPU). The outsole body 32 extends along the heel region 18, the midfoot region 20, and the forefoot region 22.

In addition, the outsole 16 includes at least one plate 34 coupled to the outsole body 32. Specifically, the plate 34 can be secured on the outsole body 32. In the depicted embodiment, the outsole 16 includes a plurality of plates 34. In particular, the outsole 16 includes a first plate 34*a*, a second plate 34*b*, and a third plate 34*c*. It is contemplated, however, that the outsole 16 may include more or fewer plates 34. Regardless of quantity, each plate 34 is wholly or partly made of a material that is harder than the material forming the outsole body 32 in order to minimize spin of at least one foot during the backswing and downswing stages of a golf swing. In other words, the hardness of the material forming the plate 34 is greater than the hardness of the material forming the outsole body 32. In the present disclosure, the term "hardness" is a measure of the material resistance to permanent deformation due to a contact compression load. For instance, the indentation hardness of the material forming the plates 34 (e.g., measured in Shore A or D Hardness Scale) is greater than the hardness of the material forming the outsole body 32. As a non-limiting example, the hardness of the material forming the plate 34 can be between twenty (20%) and thirty (30%) percent greater than the hardness of the material forming the outsole body 32 in order to minimize spin of at least one foot during the backswing and downswing stages of a golf swing. To this end, for example, the outsole body 32 may be wholly or partly made of EVA, and the plate 34 may be wholly or partly made of TPU. Alternatively, the outsole body 32 and the plates 34 can be made of the same or similar materials, but with different densities, in order to achieve the different hardnesses. At least one of the plates 34 may be made of transparent material.

Each of the plates 34 includes a plate body 36 disposed on the outsole body 32 and a plurality of traction elements 38 protruding from the plate body 36. In the depicted embodiment, the traction elements 38 are fins 40 extending from the plate body 36. The fins 40 are arranged substantially parallel to each other in order to enhance the engagement of the sole structure 12 with the ground, thereby minimizing spin of at least one foot during the backswing and downswing stages of a golf swing.

Each fin 40 includes a fin body 42 extending along a lateral direction LT in order to provide stability to the sole structure 12 along the central longitudinal axis X. In other words, the fin bodies 42 are elongated along the lateral direction LT. In the present disclosure, the term "lateral direction" refers to a direction from the medial edge 26 of the outsole 16 to the lateral edge 24 and perpendicular to the central longitudinal axis X. During a golf swing, the fin bodies 42 penetrate the ground and therefore inhibit the sole structure 12 from the moving along a longitudinal direction LG. In the present disclosure, the term "longitudinal direction" means a direction from the foremost edge 28 to the rearmost edge 30 of the outsole 16 and perpendicular to the lateral direction LT. The fins 40 in the second plate 34*b* are spaced from each other in the longitudinal direction LG and the lateral direction LT to enhance the lateral and longitudinal stability of the sole structure 12 during the backswing and downswing of a full golf swing.

In the depicted embodiment, the fin bodies 42 are planar and have a varying height. For example, the height of some of the fin bodies 42 decreases in a direction toward the central longitudinal axis X. As such, of each fin body 42 provides stability along the longitudinal direction LG while minimizing the weight of the sole structure 12. Most of the fin bodies 42 are parallel to each other to enhance the stability of the sole structure 12.

At least some of the fins 40 include a gusset 44 protruding directly from the fin body 42. In particular, at least some of the gussets 44 extend substantially perpendicularly relative to the fin body 42 in the longitudinal direction LG in order to provide stability to the sole structure 12 along the lateral direction LT. Each fin body 42 is longer than the gusset 44 attached thereto. The gussets 44 reinforce the fins 40 against bending in the longitudinal direction LG. In other words, the gussets 44 are elongated along the longitudinal direction LG. Although most of the gussets 44 are planar in order to enhance the lateral stability of the sole structure 12, some of the gussets 44 may have a curved profile. As a non-limiting example, a foremost gusset 44*f* and a rearmost gusset 44*r* in the third plate 34*c* have curved shapes in order to conform to an outermost sole periphery 46 of the sole structure 12, thereby enhancing the comfort of the wearer of the article of footwear 10. Other plates 34, such as the first plate 34*a* and the second plate 34*b*, may also include gussets 44 having curved shapes. Each fin body 42 has a first end 42*a* and a second end 42*b* opposite the first end 42*a*, and the gusset 44 are directly attached at or near one of the ends (i.e., the first end 42*a* or the second end 42*b*) of the gusset 44 to maximize the resistance to rotation of the sole structure 12 during the backswing and downswing of a golf swing. Most of the gussets are parallel to each other to enhance the stability of the sole structure 12.

The first plate 34*a* is disposed on the outsole body 32 only at the forefoot region 22 of the outsole 16, whereas the second plate 34*b* is disposed on the outsole body 32 and extends along the forefoot region 22, the midfoot region 20, and the heel region 18 of the outsole 16. The third plate 34*c* is disposed on the outsole body 32 at the heel region 18. The second plate 34*b* is spaced apart from the first plate 34*a* so as to define a curved groove (i.e., the first curved groove 48). The first curved groove 48 extends from the foremost edge 28 to the lateral edge 24 to provide flexibility along the forefoot region 22 to the outsole 16. The second plate 34*b* is spaced apart from the third plate 34*c* so as to define a curved groove (i.e., the second curved groove 50). The second curved groove 50 extends from the medial edge 26 to the rearmost edge 30 of the outsole 16 in order to provide flexibility in the heel region 18. The second plate 34*b* has a curved shape and defines openings 52 between the fins 40 arranged parallel to each other in order to enhance the flexibility of the outsole 16. The openings 52 can be configured as slots 54 arranged parallel to each other. The parallel arrangement of the slots 54 also provides flexibility to the sole structure 12. The second plate 34*b* has a first or forefoot plate portion 35, a second or midfoot plate portion 37, and a third or heel plate portion 39 directly interconnected to one another. The midfoot plate portion 37 directly interconnects the forefoot plate portion 35 and the heel plate portion 39. The forefoot plate portion 35 of the second plate 34*b* is disposed at the forefoot region 22 and closer to the medial edge 26 than the lateral edge 24 of the outsole 16. The midfoot plate portion 37 of the second plate 34*b* is disposed at the midfoot region 20 of the outsole 16 and is obliquely angled relative to the central longitudinal axis X. The heel plate portion 39 of the second plate 34*b* is disposed at the heel region 18 of the outsole 16 and is disposed closer to the lateral edge 24 than the medial edge 26 of the outsole 16. The structural arrangement and position of the first plate portion 35, the second plate portion 37, and the third plate portion 39 of the second plate 34*b*, as described above, aids in providing flexibility to the outsole 16.

While the best modes for carrying out the teachings have been described in detail, those familiar with the art to which this disclosure relates will recognize various alternative designs and embodiments for practicing the teachings within the scope of the appended claims.

What is claimed is:

1. A sole structure for an article of footwear, comprising:

an outsole having a forefoot region, a heel region, and a midfoot region between the heel region and the forefoot region, a lateral edge, and a medial edge, wherein the outsole includes: an outsole body made of a first material, wherein the first material has a first hardness;

a first plate, a second plate, and a third plate each disposed on the outsole body, wherein each of the first plate, the second plate, and the third plate is made of a second material, the second material has a second hardness, the second hardness is greater than the first hardness, the first plate is coupled to the outsole body at the forefoot region, the second plate is a one-piece structure that extends along the forefoot region, the midfoot region, and the heel region of the outsole, the first plate and the second plate are spaced apart from each other so as to define a curved groove, and each of the first plate, the second plate, and the third plate includes:

a plate body disposed on the outsole body;

a plurality of fins extending from the plate body, wherein at least two of the plurality of fins are parallel to each other, and at least one of the plurality of fins includes:

a fin body extending along a lateral direction, wherein the lateral direction extends between the lateral edge and the medial edge; and a gusset protruding from the fin body, wherein the gusset extends substantially perpendicularly relative to the fin body in a longitudinal direction, and the longitudinal direction extends between the heel region and the forefoot region.

2. The sole structure of claim 1, wherein the second plate defines a plurality of openings between the plurality of fins.

3. The sole structure of claim 2, wherein the plurality of openings are slots that are arranged parallel to each other.

4. The sole structure of claim 3, wherein the third plate is coupled to the outsole body at the heel region.

5. The sole structure of claim 3, wherein the outsole extends along a central longitudinal axis, the second plate includes a forefoot plate portion, a heel plate portion, and a midfoot plate portion interconnecting the forefoot plate portion and the heel plate portion, and the midfoot plate portion is obliquely angled relative to the central longitudinal axis.

6. The sole structure of claim 5, wherein the outsole has a foremost edge between the lateral edge and the medial edge, and a rearmost edge between the lateral edge and the medial edge, and the curved groove extends from the foremost edge to the lateral edge.

7. The sole structure of claim 6, wherein the curved groove is a first curved groove, and the second plate and the third plate are spaced apart from each other so as to define a second curved groove, and the second curved groove extends from the medial edge to the rearmost edge of the outsole.

8. The sole structure of claim 3, wherein at least two of the plurality of fins of the second plate are spaced relative to each other along the longitudinal direction and the lateral direction.

9. The sole structure of claim 1, wherein the fin body is elongated along the lateral direction.

10. The sole structure of claim 1, wherein the gusset is elongated along the longitudinal direction.

11. An outsole for a sole structure, comprising:

an outsole body having a forefoot region, a heel region and a midfoot region between the heel region and the forefoot region;

a first plate, a second plate, and a third plate each disposed on the outsole body, wherein the second plate is a one-piece structure that extends along the forefoot region, the midfoot region, and the heel region of the outsole body, the first plate and the second plate are spaced apart so as to define a curved groove, and each of the first plate, the second plate, and the third plate includes:

a plate body disposed on the outsole body;

a plurality of fins extending from the plate body, wherein at least two of the plurality of fins are parallel to each other, and at least one of the plurality of fins includes:

a fin body extending along a lateral direction; and a gusset protruding from the fin body, wherein the gusset extends substantially perpendicularly relative to the fin body in a longitudinal direction.

12. The outsole of claim 11, wherein the second plate defines openings between the plurality of fins.

13. The outsole of claim 12, wherein the openings include slots arranged parallel to each other.

14. The outsole of claim 12, wherein the first plate is coupled to the outsole body at the forefoot region of the outsole body.

15. The outsole of claim 14, wherein the third plate is coupled to the outsole body at the heel region.

16. The outsole of claim 14, wherein the outsole extends along a central longitudinal axis, the second plate includes a forefoot plate portion, a heel plate portion, and a midfoot plate portion interconnecting the forefoot plate portion and the heel plate portion, and the midfoot plate portion is obliquely angled relative to the central longitudinal axis.

17. The outsole of claim 14, wherein at least two of the plurality of fins of the second plate are spaced relative to each other along the longitudinal direction and the lateral direction.

18. The outsole of claim 11, wherein the fin body is elongated along the lateral direction.

19. The outsole of claim 11, wherein the gusset is elongated along the longitudinal direction.

* * * * *